United States Patent [19]

Andersen

[11] Patent Number: 4,911,211

[45] Date of Patent: Mar. 27, 1990

[54] APPARATUS AND METHOD FOR CHANGING COOLANT IN VEHICLE COOLING SYSTEM

[76] Inventor: Robert A. Andersen, 2019 Fir St., Glenview, Ill. 60025

[21] Appl. No.: 386,109

[22] Filed: Jul. 28, 1989

Related U.S. Application Data

[63] Continuation-in-part of Ser. No. 265,551, Nov. 1, 1988, abandoned.

[51] Int. Cl.[4] ..... B08B 9/00; F28G 9/00

[52] U.S. Cl. ..... 141/7; 141/65; 141/98; 141/230; 141/92; 141/382; 165/95; 123/41.14; 134/169 A; 137/142; 137/636

[58] Field of Search ..... 141/98, 1, 7, 65, 382, 141/387, 388, 230, 231, 85, 92; 165/95; 123/41.14; 184/1.5; 134/169 A, 22.12; 137/142, 636

[56] References Cited

U.S. PATENT DOCUMENTS

| | | | |
|---|---|---|---|
| Re. 31,274 | 6/1983 | Babish et al. | 165/95 |
| 643,605 | 2/1900 | Pendergratt | 137/142 |
| 2,029,232 | 1/1936 | Green . | |
| 2,835,234 | 5/1958 | Rasch et al. . | |
| 2,959,184 | 11/1960 | Mahan | 137/142 |
| 3,034,521 | 5/1962 | Greenfield | 134/169 A |
| 3,409,218 | 11/1968 | Moyer . | |
| 3,797,538 | 3/1974 | Mollura | 141/382 |
| 4,083,399 | 4/1978 | Babish et al. | 165/95 |
| 4,109,703 | 8/1978 | Babish et al. | 165/95 X |
| 4,127,160 | 11/1978 | Joffe | 165/95 X |
| 4,161,979 | 7/1979 | Stearns | 165/95 |
| 4,176,708 | 12/1979 | Joffe | 165/95 |
| 4,213,474 | 7/1980 | Harrison . | |
| 4,276,914 | 7/1981 | Albertson | 141/92 |
| 4,293,031 | 10/1981 | Babish et al. | 165/95 |
| 4,378,034 | 3/1983 | Albertson | 141/1 |
| 4,390,049 | 6/1983 | Albertson | 141/92 |
| 4,479,274 | 10/1984 | Biby . | |
| 4,688,308 | 8/1987 | Alvarez . | |
| 4,791,890 | 12/1988 | Miles et al. | 123/41.14 |

OTHER PUBLICATIONS

Crouse, William H., "Fast-Flush-And-Fill Machine", Automotive Engine Systems (7th Ed., McGraw-Hill, 1975), pp. 237-238.

Prestone "Flush'N Fill Kit" Packaging Description J. C. Whitney & Company, Auto Parts & Accessories Book, Catalogue No. 505K for "Radiator Drain Kit", no date.

*Primary Examiner*—Ernest G. Cusick

*Attorney, Agent, or Firm*—Haight & Hofeldt

[57] ABSTRACT

An apparatus and method for changing the antifreeze in a vehicle requires only a garden hose and opening of the radiator cap. Water from the hose is utilized to prime a conduit for siphoning used coolant from a side tank radiator and for refilling the radiator. By operating the vehicle with fresh water in the radiator, coolant remaining in the system is mixed with the water, and repeated drainings decrease the remaining used antifreeze by about one-half each time. After removal of the desired amount of antifreeze, new antifreeze may be placed in the radiator.

42 Claims, 7 Drawing Sheets

FIG. 4A
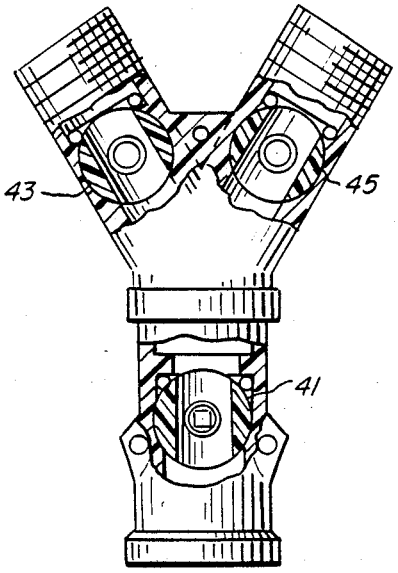
FIG. 4B
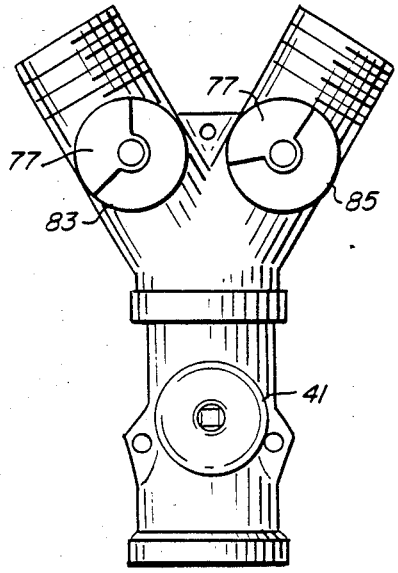
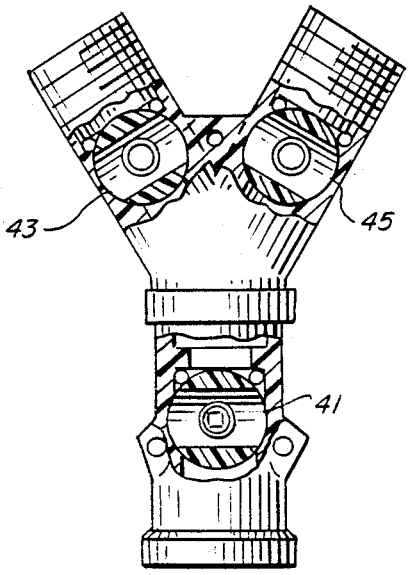
FIG. 4C
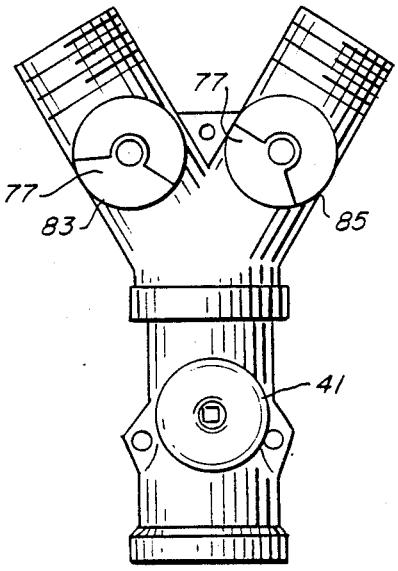
FIG. 4D

FIG. 5A
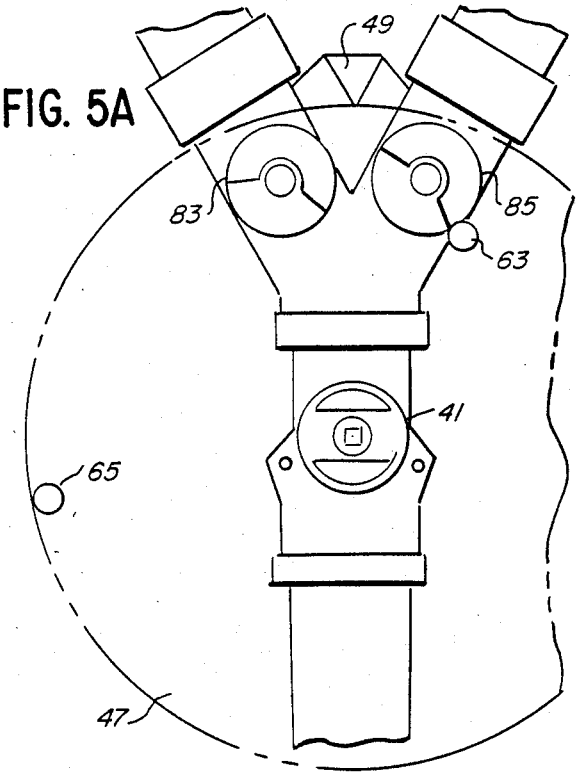
FIG. 5B
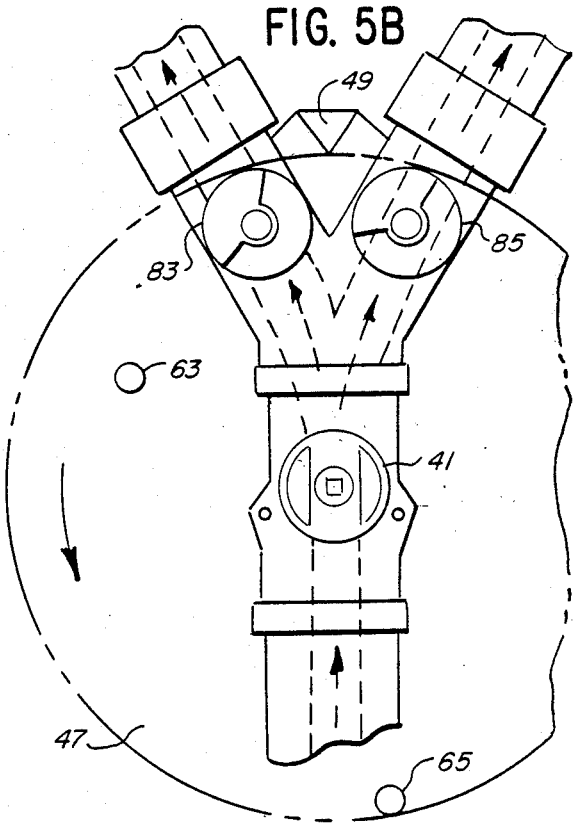
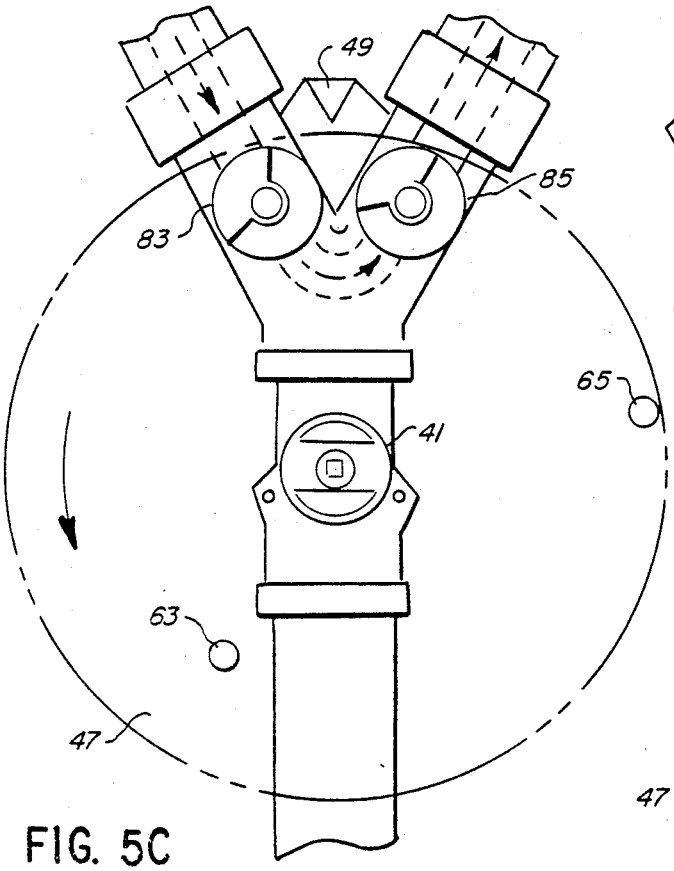
FIG. 5C
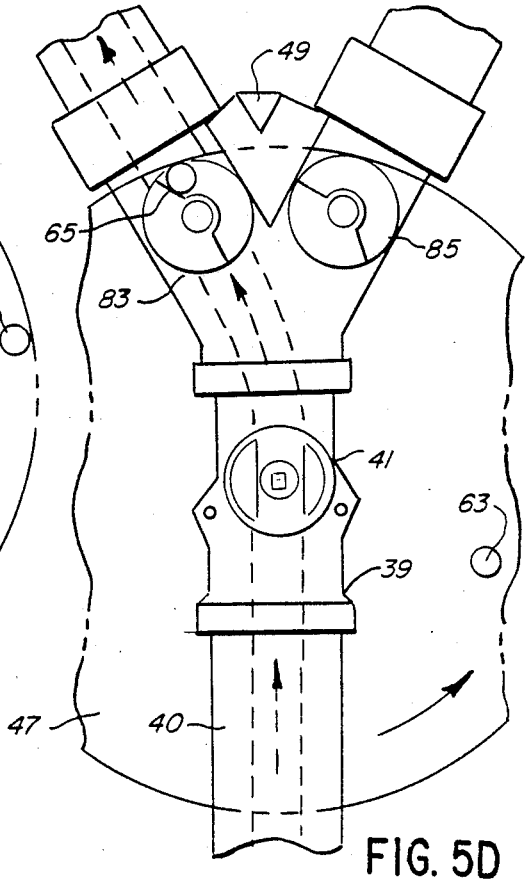
FIG. 5D

FIG. 6
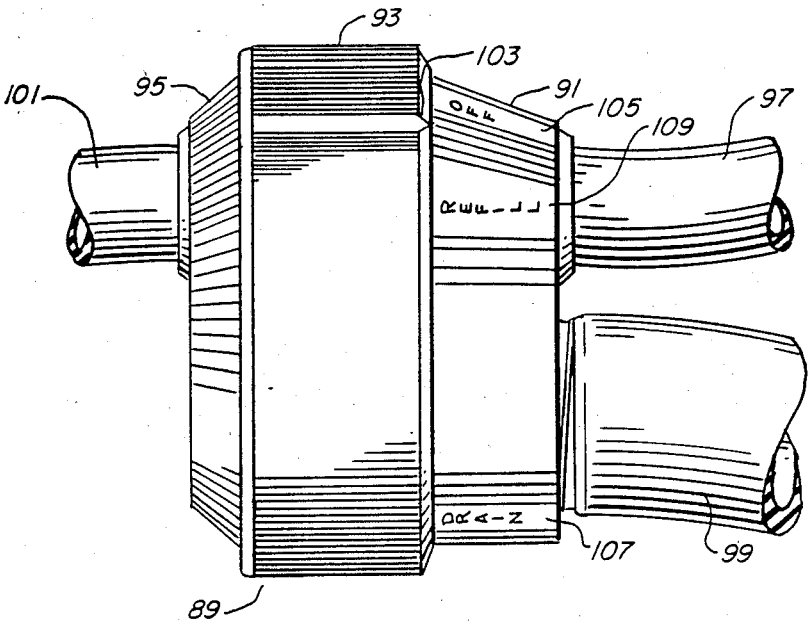
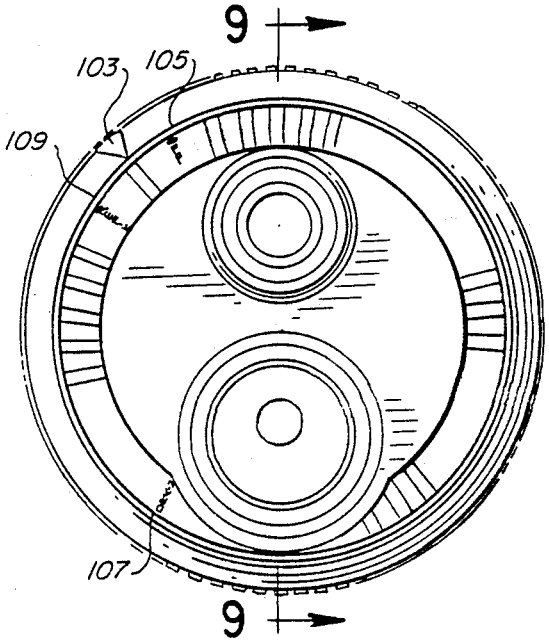
FIG. 7
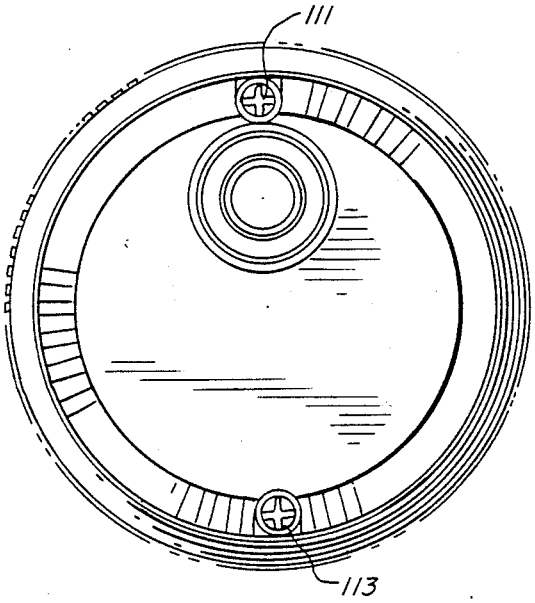
FIG. 8

FIG. 9
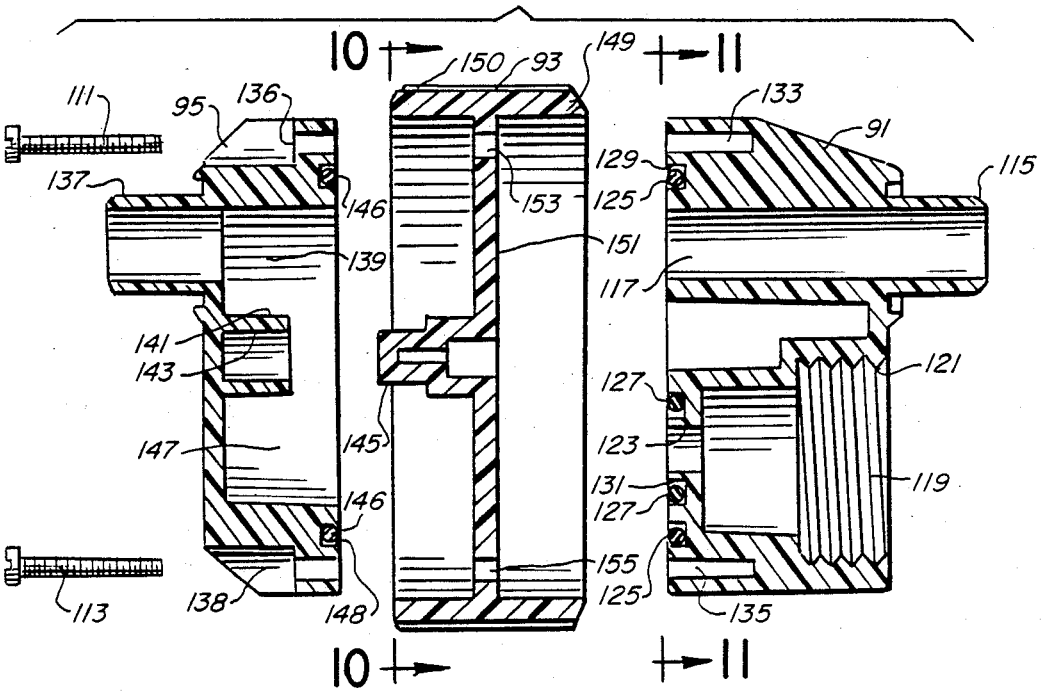
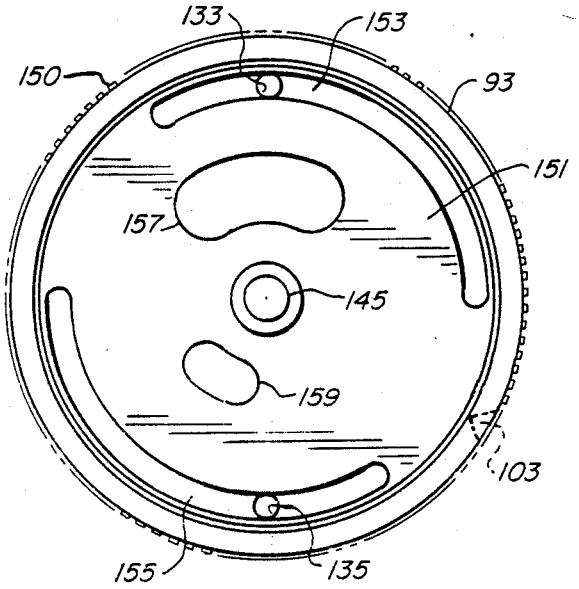
FIG. 10
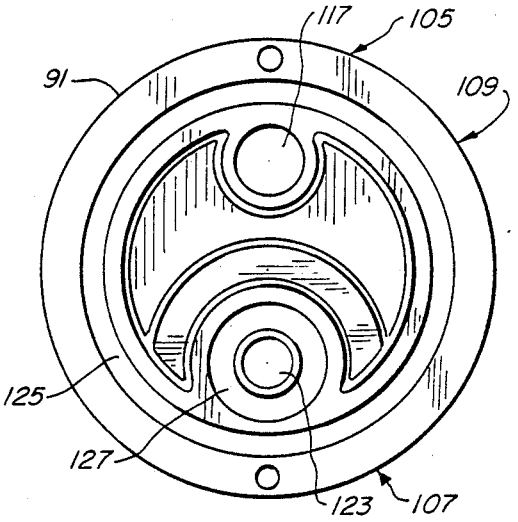
FIG. 11

APPARATUS AND METHOD FOR CHANGING COOLANT IN VEHICLE COOLING SYSTEM

RELATED APPLICATION

This application is a continuation-in-part of U.S. patent application Ser. No. 07/265,551, filed Nov. 1, 1988, now abandoned.

BACKGROUND OF THE INVENTION

1. Field of the Invention

This invention relates generally to an apparatus and method for use in removing and replacing used coolant in the cooling system of a vehicle, and more specifically, this invention relates to an apparatus and method for changing the antifreeze in an automobile cooling system by use of a garden hose.

2. Description of the Prior Art

Vehicle manufacturers typically advise owners of their vehicles to change the antifreeze in the cooling systems of those vehicles every two years, in order to prevent the accumulation of corrosion materials, such as rust and solder corrosion residue. The corrosion materials are formed as the corrosion inhibitors in antifreeze break down from heat over time. These corrosion materials reduce cooling system efficiency by interfering with the flow of coolant through the air/liquid heat exchanging fin-tubes of the radiator core. An effective cooling system is not only important for engine performance and life, but in many automobiles the transmission fluid is also cooled by circulation through the radiator Further, the abrasive nature of the suspended corrosive materials increases the wear on water pump, hoses, thermostat, and heater core—and malfunction of cooling system components is said to be the number one cause of highway breakdowns.

Accordingly, there are certainly good reasons why the vehicle makers' recommendation that the old coolant be flushed out and replaced with fresh coolant every two years should be followed. However, industry data indicates that most (about 78%) of the antifreeze sold every year is sold to do-it-yourselfers. And, only 30% of these buyers say that they change their antifreeze regularly, instead of just adding more when needed. Moreover, it is likely that many within this 30% who say that they change their antifreeze are, in fact, only removing the old coolant and corrosion materials from the radiator, and not from the whole system.

To properly change the coolant in a vehicle cooling system, it is not only necessary to drain and flush out the radiator (which normally contains 40% to 50% of the coolant in the system), but it is also necessary to drain and flush out the engine block, heater core and connecting hoses, since the remainder of the coolant is in those areas. Draining and flushing of the radiator does not drain or flush the coolant from the engine block, heater and the connecting hoses, because the flow of coolant from the latter areas to the radiator is blocked by the thermostat, which is closed unless the system is at operating temperature. Opening up a cooling system which is closed and at operating temperature is not advisable because, in this state, the system is pressurized and opening it may result in hot coolant being sprayed on the operator. Thus, coolant changes should begin only with cold systems, when the system is not pressurized, the thermostat is closed, and the flow of coolant from engine, heater and hoses to the radiator is blocked. As a result, those car owners who prudently start with a cold system and drain just the radiator are removing only the 40% to 50% of used coolant and suspended corrosion which is contained in the radiator, leaving the remainder in the rest of the system.

There are presently three general approaches an individual vehicle owner may follow to drain and flush old coolant and corrosion from the entire cooling system—not just the radiator. All have their drawbacks.

Consider first the continuous flushing technique utilized by some professional equipment, and some kits sold for do-it-yourself use [an example is a kit sold by First Brands Corporation (PRESTONE) under its trademark "FLUSH 'N FILL"]. With this technique, a sealed connection must be made by installing a garden hose-coupled inlet tee ("T") in the cooling system. This is accomplished by cutting into a heater hose and installing the inlet "T" between the severed hose ends. With the radiator drain cock open, the radiator cap off, and the engine running (to keep the thermostat open), water is continuously admitted through the inlet "T" and circulated by the water pump, displacing old coolant which discharges through the radiator drain and the radiator cap neck. After a sufficient period of time, drainage clarity indicates that old coolant and corrosion have been displaced by clean water.

For a person who is not a mechanic, utilizing this continuous flushing approach presents a number of problems:

(1) Installing the inlet "T" requires that the correct hose and installation point be identified, that the reinforced hose be cut and that the "T" be properly installed so that it does not leak (the FLUSH 'N FILL instructions recommend consulting a qualified mechanic if unsure).

(2) The approach generates a relatively large volume of waste liquid (up to 700% of cooling system capacity) flowing from both the radiator neck and the drain. This waste liquid is difficult to contain and usually is left to splash on the vehicle and the ground. Since antifreeze is composed largely of ethylene glycol, which is harmful or fatal if swallowed and is poisonous to animals, this method creates a hazardous environmental condition.

(3) The drain cock on the radiator must be opened and closed, respectively, before and after the operation.

Professional flushing equipment designed to contain waste coolant and flush liquid requires at least one additional sealed connection to be made to the cooling system, for purposes of conveying waste liquid out as flushing liquid is pumped into the system. This, of course, adds to both the cost and complexity of use of such systems.

A second method which may be used involves opening up the system at multiple points. With this approach the thermostat, heater hose and the lower engine-to-radiator hose are removed, and the drain cocks on the engine and the radiator are opened. It is then possible to flush water through the various parts of the system without the need to install a permanent inlet "T" or run the engine to keep the thermostat open. However, there are also problems with this approach.

Consider first the draining of old coolant and flush water from the radiator. The radiator can be drained by either opening the drain cock located on the engine side of the radiator near the bottom or by removing the bottom radiator to-engine hose, which is also located on the engine side of the radiator near the bottom of the radiator. (For complete flushing, the drain cock would be opened and the hose would be removed.) For a person who is not a mechanic, performing this seemingly simple task involves a number of practical difficulties:

(1) Either opening the drain cock or removing the bottom hose frequently requires the operator to get under the car, because there is insufficient room in the engine compartment: to pull hard enough on the bottom hose to remove it from the radiator mounting tube without damaging it or causing injury; or to use a wrench on the drain cock handle, which is intended for hand turning but frequently is stuck so tight by corrosion that it requires a wrench. Many automobiles do not have sufficient clearance to permit the operator to perform either of these operations without jacking up the car, with the attendant danger.

(2) Use of a wrench on the handle of a drain cock stuck by corrosion involves a substantial risk of breakage, requiring either a difficult replacement of the drain cock or the more expensive replacement of the entire radiator.

(3) Even with the retaining clamp removed, radiator hoses frequently adhere so tenaciously to the radiator hose mounting tube (which, like the radiator itself, is made of light gauge, soft metal), that it is necessary to either cut the hose off the tube or to use a screwdriver or pry bar to push the hose off the tube. If cut, the hose must be replaced, and either cutting or prying the hose risks damage to the mounting tube itself, which again could result in the need to replace the radiator.

(4) Immediately upon opening the drain cock or hose, used coolant flows out, frequently resulting in both the operator and the ground being covered by the used coolant before a receptacle can be used to collect it.

Draining coolant and flush water from the engine block, the heater and the connecting hoses is an even greater problem:

(1) Engine drain cocks are generally even more difficult to access through the engine compartment than radiator drain cocks, and they more frequently require the operator to jack-up and get under the car to open and close them.

(2) Removal of the thermostat requires: unbolting a housing from the engine block; prying the thermostat loose from its gasket and sealant without damaging it; scraping the mounting surface clean; and replacing the thermostat gasket and sealant upon re-mounting of the thermostat.

(3) Removal of heater hoses presents the same type of difficulties encountered in removing engine-to-radiator hoses, and replacement of the two heater hoses (which are very similar in appearance) in their proper locations is an added problem.

(4) With the system open at many points for flushing purposes, it is difficult to collect the waste and flush water exiting these many openings when flush water is injected.

The third method of draining and flushing the entire cooling system involves repeatedly draining the radiator, refilling it with water, and running the engine to normal operating temperature. This causes the thermostat to open and permits the coolant previously trapped in the engine, heater and hoses to mix with the clean water added to the radiator. Because in a typical cooling system the water pump has the capacity to turn over many times the total system capacity every minute, and the thermostat, when open, will likewise permit many times the system capacity to circulate to the radiator each minute, the fresh water is quickly and thoroughly mixed with remaining used coolant.

By repeating the sequence of steps, the amount of old coolant and corrosion remaining in the system can be reduced by approximately one-half each time the radiator is emptied. Thus, the first time the radiator is emptied, approximately one-half of the used coolant in the system is removed. After running the engine to mix the remaining used coolant with the fresh water, draining of the radiator reduces the remaining used coolant to one-quarter of that initially contained in the the cooling system. The third repetition reduces it to one-eighth; the fourth to one-sixteenth, etc.

In this way, the operator can flush a high percentage of the total old coolant and corrosion from his entire cooling system (not just the radiator) without the need to open drain cocks or hose connections on the engine. While mechanically simpler, however, this method nevertheless requires a great deal of physical labor. The operator must get under the automobile several times to open and close the radiator drain cock, or to remove and replace the bottom radiator-to-engine hose, whichever draining procedure is being used. Also, if the car had to be jacked up to take these actions, it would have to be let down each time in order to run the engine. Thus, for example, to flush at least 87.5% of the old coolant from the system requires that the radiator be drained three times, which would require that the operator get under the automobile six times (three times to open the draining point and three more times to close the draining point). Further, after the first engine warm-up to open the thermostat, the operator would either have to open the draining point on a hot radiator or wait some period of time for the system to cool down before proceeding.

Although a pump could be utilized to drain the radiator, in order to avoid the need to repeatedly open and close the drain cock, most automobile owners could not justify the cost of such a pump, nor would they be willing to undertake the storage and maintenance of such a pump.

Accordingly, while there are clearly good reasons to flush out and recharge cooling systems in accordance with the vehicle maker's recommendations, many car owners do not do so because of the attendant difficulty of the task. Therefore, there are a great number of vehicles that are not serviced as they should be, with the associated high costs of: (1) poorer performance and more frequent maintenance; (2) shortened engine life; and (3) more frequent highway break down. Such costs could be reduced by providing a way for individual vehicle owners to properly flush their cooling systems and recharge them with fresh antifreeze, without the need of substantial mechanical expertise and physical labor, or the need to acquire expensive pumping equipment.

SUMMARY OF THE INVENTION

The present invention provides a relatively low cost apparatus and method which enables individual vehicle owners to use the aforementioned approach of repeatedly draining and refilling the radiator with fresh water, but greatly reduces the difficulty and time requirement of doing so, by:

(1) providing a conduit suitable for both extracting used coolant and injecting replacement water through the radiator cap opening as the only interface with the cooling system, thus requiring that only the radiator cap, and not the drain cocks or hoses, be opened;
(2) not requiring any sealed connection to the cooling system, so that the only contact of the operator with the cooling system is the unsealed insertion of the conduit through the radiator cap opening;
(3) providing a control device which is simple to understand and operate to achieve the desired result;
(4) making it safe for the operator to repeat the draining and refilling of the radiator, even when the system is at operating temperature, rather than waiting for the system to cool down;
(5) minimizing and fully containing used coolant and flush water for proper disposal; and
(6) requiring, as additional equipment, only a garden hose connected to a faucet or other source of water under pressure, and a common household bucket.

In the preferred approach, the only energy source required is the pressurized water from the garden hose (other than manual actuation of the control device).

The present invention is utilizable only with the "cross flow" or "side tank" type of radiator, where the radiator tanks are vertically positioned on either side of the radiator core. Almost 90% of domestic vehicles use the "cross flow" radiator, although only 20% of imported cars in operation are so equipped.

In order to achieve the desired results, an apparatus is provided with a conduit which is inserted into the radiator through the radiator cap opening. An extraction means is utilized to drain the contents of the radiator. This extraction means can take any suitable form, but in the preferred embodiment disclosed herein a siphon arrangement is employed. In this siphon arrangement, the conduit extends from the radiator to a disposal device, such as a common household bucket. A first section of the conduit is insertable through the radiator cap opening, with a first end located adjacent the bottom of the radiator. A second section of the conduit extends from the top outside of the radiator down to the bottom of a disposal device positioned at ground level, or at least below the level of the bottom of the radiator. One portion of the conduit is transparent or translucent so that flow through the conduit may be observed.

A body member having: a passageway interconnecting the first and second sections of conduit; a connecting device, such as an ordinary female hose connector; a valving system; and a manually actuatable control device, such as a dial or handle, appropriately marked to indicate to which condition the control device is set, is located at a point intermediate the first and second sections of the conduit. The connecting device provides for the injection of fresh water into the conduit to prime the siphon and to refill the radiator.

The valving system is constructed to provide four operating conditions in a desired sequence, which the operator may control by turning the control device. In the first of these conditions ("PRIME"), water from the source connected to the body member is permitted to flow into the conduit, in order to "prime" the conduit sufficiently to initiate a siphon in the conduit. In the second condition ("DRAIN"), the source of water is shut off from the conduit so that the coolant in the radiator is extracted by siphoning it into the disposal device. In the third condition ("REFILL"), the source of water is connected only to the first section of the conduit, so that fresh water is injected into the radiator, until it is refilled In the fourth condition ("OFF"), the source of water is shut off and flow through the conduit is also blocked, so that the engine may be idled with the first end of the conduit still in the radiator, without coolant being siphoned out.

To use the present invention, the operator simply: attaches a garden hose to the body member via the connecting device provided; removes the radiator cap and inserts the first section of conduit through the cap opening to the bottom of the radiator; and positions the second section of conduit over the front or side of the vehicle, downward to the bottom of the disposal device at ground level. With the control means set at the OFF position, the source of water to the garden hose may be turned on.

By then simply turning the dial or handle of the control device in the indicated sequence, the operator may drain the coolant from the radiator through the conduit by siphoning, and then refill the radiator with fresh water through the first section of the conduit. The engine may then be idled, with the apparatus still in place, to cause the thermostat to open, allowing remaining used coolant to be mixed by the engine water pump with the fresh water injected. After idling the engine, the aforementioned sequence may immediately be repeated, since the operator need not touch any portion of the hot cooling system, only the body member of the present invention, to do so.

The operator may repeat the simple series of steps described above as many times as desired, but it should be noted that three drainings, two followed by fresh water refillings, and a final draining followed by addition of fresh antifreeze, will typically result in approximately 88% of the old coolant having been removed from the system. After the third (or other, as desired) draining, the operator removes the first section of conduit from the radiator before recharging the system with fresh antifreeze.

It should be noted that the operator may also use the apparatus of the present invention to drain and refill the cooling system reservoir bottle in the same manner in which the radiator was drained and refilled, without having to remove the reservoir bottle from the vehicle.

Finally, it should be noted that, with the present invention, the volume of used coolant and flush water typically amounts to 150% of the cooling system's capacity, a very modest quantity in contrast to the waste volume (up to 700% of cooling system capacity) generated by continuous flushing techniques, and that all old coolant and flush water removed from the cooling system has been fully contained by conveyance to the disposal device, for proper disposal.

These and other objects, advantages and features of this invention will hereinafter appear, and for purposes of illustration, but not of limitation, exemplary embodiments of the subject invention are shown in the appended drawing.

BRIEF DESCRIPTION OF THE DRAWING

FIG. 4 is a schematic view showing the relationship between the valving system and the cam followers in the preferred embodiment of FIG. 1, with FIG. 4A showing the valves in an open condition, FIG. 4B showing the positions of the cam followers when the valves are in an open condition, FIG. 4C showing the valves in a closed condition and FIG. 4D showing the position of the cam followers when the valves are in the closed position.

FIG. 5 is a schematic view of the valving system of the preferred embodiment of FIG. 1 showing the flow of liquid through the valving system in four different operating conditions, with FIG. 5A showing the off condition, FIG. 5B showing the prime condition, FIG. 5C showing the drain condition and FIG. 5D showing the refill condition.

FIG. 6 is a side elevational view of an alternative preferred embodiment, now the best mode.

FIG. 7 is a rear elevational view of the preferred embodiment of FIG. 6.

FIG. 8 is a front elevational view of the preferred embodiment of FIG. 6.

FIG. 9 is an exploded cross sectional view of the preferred embodiment of FIG. 6, taken along line 9—9 of FIG. 7.

FIG. 10 is a front elevational view of a rotating control disk member of the preferred embodiment of FIG. 6, taken along line 10—10 of FIG. 9.

FIG. 11 is a front elevational view of the rear housing member of the preferred embodiment of FIG. 6, taken along line 11—11 of FIG. 9.

DETAILED DESCRIPTION OF THE PREFERRED EMBODIMENTS

Figure 1:
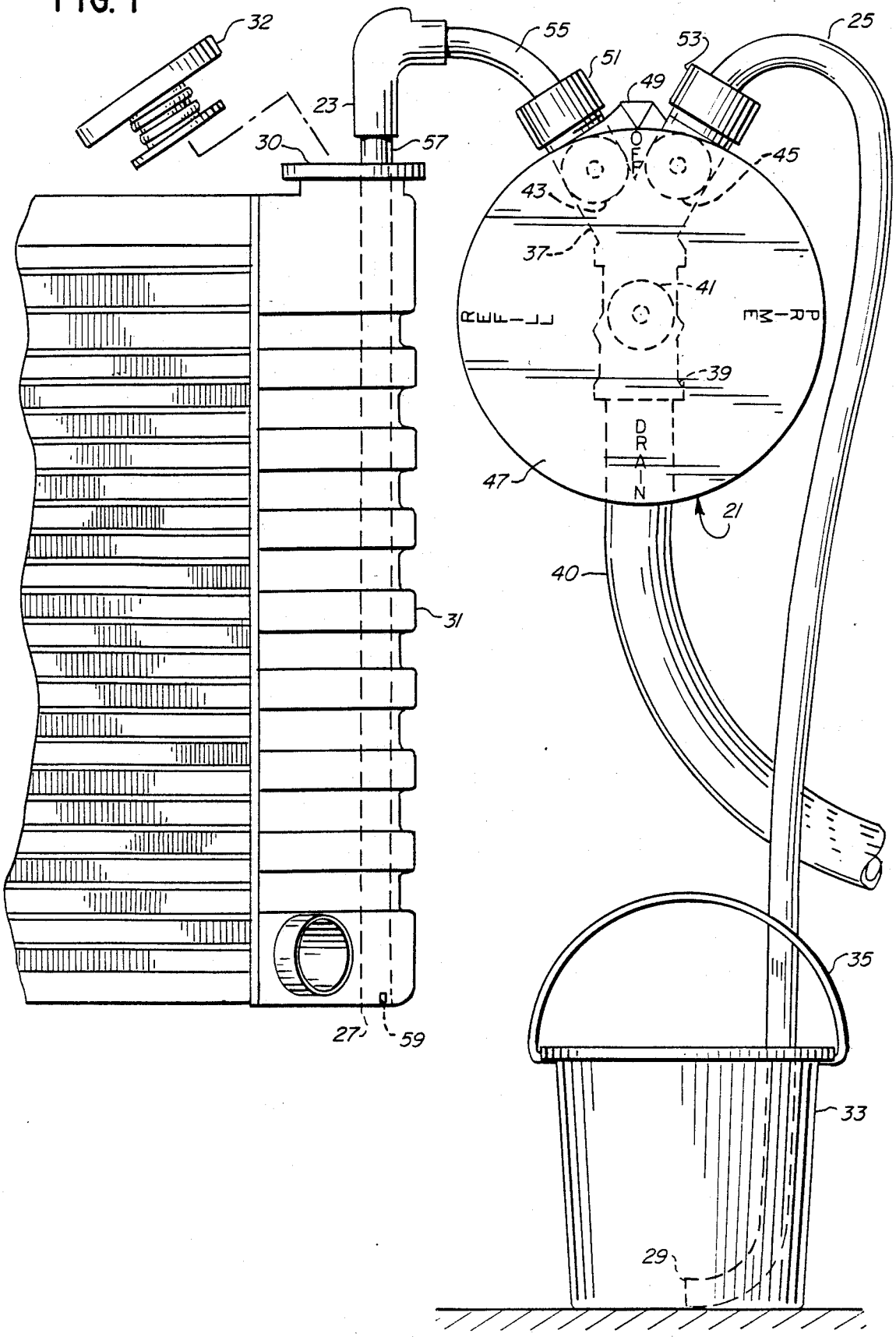
FIG. 1 is a top plan view of a first preferred embodiment of the present invention.

A first embodiment of the antifreeze changing apparatus of the present invention is illustrated in FIG. 1. A body member 21 is connected to a first section of tubing 23 and a second section of tubing 25. Tubing sections 23 and 25, together with a connecting passageway within the body member 21, form a conduit from a first end 27, which is also the end of the section 23, to a second end 29, which is also the end of the tubing section 25.

A portion of tubing section 23, which has an external diameter of less than one inch (and preferably about one half inch), may readily be inserted through a radiator cap opening 30 of a radiator tank 31, after removal of the radiator cap 32. The tubing is not sealed to the radiator at radiator cap opening 30 and is inserted until the first end 27 of the conduit reaches the bottom of a "side tank" or "cross flow" radiator tank (typically at an elevation of 12 inches or more above ground level). The second end 29 of the conduit extends to the bottom of a suitable disposal device positioned at ground level (or at least below the bottom of the radiator tank 31), shown schematically here as a simple waste bucket 33 having a handle 35. Waste bucket 33 would typically have a capacity of three gallons.

In this particular embodiment, the connecting passageway to complete the conduit is formed through a "Y" structure 37 that is part of body member 21. In use, body member 21 would normally be situated on top of the radiator 31. Thus, viewed as a whole, the conduit from first end 27 at the bottom of radiator tank 31 to end 29 at the bottom of waste bucket 33 forms an inverted U-tube structure appropriate for siphoning from a higher source (the radiator) to a lower destination (the ground level disposal device).

Tubing section 23, in this preferred embodiment, includes a flexible hose portion 55 and a relatively rigid (semi-rigid) pipe portion 57. Pipe portion 57 should be sufficiently long to reach the bottom of 11 or most radiators, and it has been found that a length of twenty-four inches would meet this criterion. In order to prevent the end 27 of tubing section 23 from being blocked while in the radiator, some type of antiblocking arrangement should be utilized, such as notches 59 that permit liquid to flow in from the sides around end 27.

Tubing section 25 is illustrated as a flexible hose, which should be of sufficient length to extend from body member 21, when resting on top of the vehicle radiator during use, over the front or side of all or most vehicles, at least to ground level. It has been found that a length of forty-eight inches for section 25 satisfies this criterion. In addition, it is preferable to have some portion of one of the tubing sections 23 and 25 transparent, for example the hose portion 55 of section 23, so that the operator can visually determine when the flow of liquid from the radiator has ceased.

Both tubing sections 23 and 25 could be modified as required or desired. However, there is some criticality in the internal diameter of the conduit from the end 27 to the end 29, in order to achieve optimum operation. The internal diameter of the tubing sections 23 and 25 and the interconnecting passageway through the "Y" 37 of body member 21, which together form the conduit used for siphoning, is significant because the diameter of the siphon conduit directly determines the draining rate. If the internal diameter is too large, and the draining rate thus too high, the siphon can evacuate liquid from the radiator tank 31 into which the first section of tubing 23 is inserted faster than coolant located in other cooling system components, such as the opposite radiator tank and the engine block, can migrate to the first tank. The result will be an incomplete draining since the siphon will empty the tank immediately adjacent to conduit end 27, draw in air and cease to operate before all coolant which could migrate to the drain point at end 27 has had a chance to do so. In addition, if the tubing sections 23 and 25 are too large, more time and more water are required to prime the conduit sufficiently to initiate siphoning.

On the other hand, if the internal diameter of the tubing sections 23 and 25 is too small, it reduces the draining rate and thus increases the time needed to drain the system. If the draining proceeds too slowly, this may minimize the amount of coolant which can be removed from the engine, heater and hose portions of the cooling system during drainings initiated with the system at operating temperature. This is a function of the relatively short period of time required for the thermostat to close and block further coolant migration to the radiator, once the engine block coolant level drops below the temperature sensing surface of the thermostat. With the foregoing in mind, and based on experimentation, an internal diameter of approximately three-eighths inch has been determined to be the preferred size for the tubing sections 23 and 25, and the passageway in the section 37 forming the siphoning conduit, although sizes up to one-half inch and down to one-quarter inch will also work, if somewhat less ideally.

The "Y" structure 37 which completes the conduit from end 27 to end 29 has a connecting structure 39 at the end of the leg of the "Y". (It should be recognized, of course, that other types of valving systems and body member structures may be utilized, and that the various ports of the "Y" structure could be utilized for different connections than the specific ones described in this particular embodiment). In this particular embodiment, the "Y" structure 37 is a simple garden hose "Y", and the connecting means 39 is a common garden hose connector adapted to attach to a source of water under pressure, delivered through a garden hose 40.

The particular valving system employed in this embodiment includes three valves members 41, 43 and 45. These valve members 41, 43 and 45 may be any type of suitable valve, such as conventional one-quarter turn ball valves, which are illustrated in FIG. 4. FIG. 4A shows valve members 41, 43 and 45 in the open position, while FIG. 4C shows them in the closed position, after being turned counter-clockwise one-quarter of a revolution.

Figure 3A:
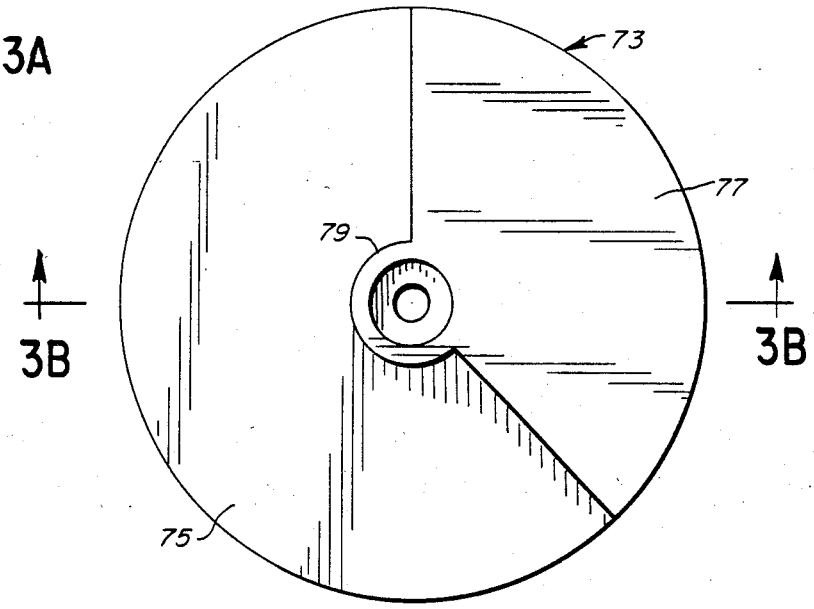
FIG. 3 illustrates a cam follower utilized in the preferred embodiment of FIG. 1, with FIG. 3A being a top plan view, FIG. 3B being a cross-sectional view taken along line 3B—3B, and FIG. 3C being a bottom plan view thereof.
Figure 3B:
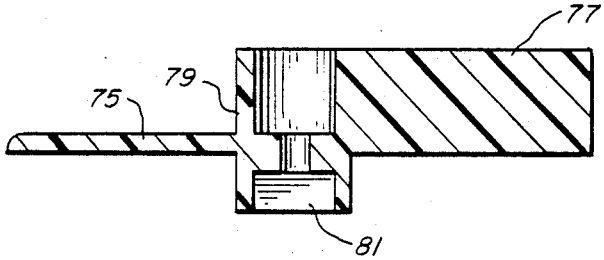
Figure 3C:
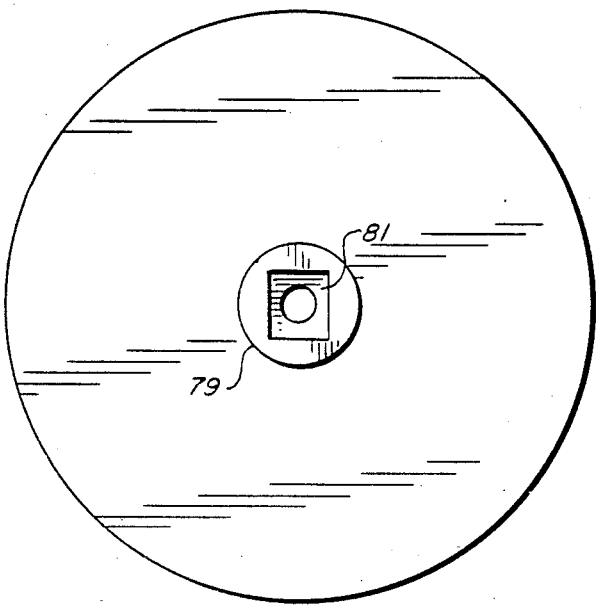

Suitable cam followers are associated with each of the valving members 43 and 45. An example of such a cam follower is illustrated in FIG. 3. This circular cam follower 73 has a disk portion 75 and a raised portion 77. The structure may be better seen from the cross-sectional view of FIG. 3B than in the top plan view of FIG. 3A. A central mounting structure 79 is provided to mount the cam follower on the actuating valve stem of the associated valve member. A socket 81 for receiving the valve stem of the associated valve member is shown in FIG. 3B and in the bottom plan view of FIG. 3C.

In FIG. 4 the relationship of the cam follower placements to the positions of the ball valves 43 and 45 is illustrated. Thus, valve member 43 which is shown in the open position in FIG. 4A, is shown in FIG. 4B as having its associated cam follower 83 in the position illustrated, while valve member 45 which is shown in the open position in FIG. 4A is shown in FIG. 4B to have its associated cam follower 85 in the position illustrated. FIG. 4C shows valve members 43 and 45 in the closed position, and FIG. 4D shows the position of their associated cam followers 83 and 85, respectively, after the valves 43 and 45 have been rotated counter-clockwise one-quarter turn from the open positions illustrated in FIGS. 4A and 4B.

Figure 2A:
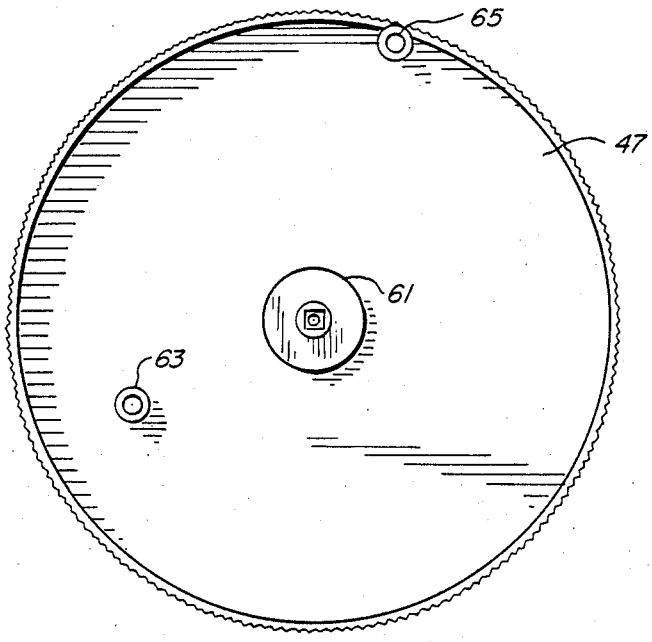
FIG. 2 depicts a cam actuator utilized in the embodiment of FIG. 1, with FIG. 2A being a bottom plan view, FIG. 2B being a perspective view and FIG. 2C being a top plan view thereof.
Figure 2B:
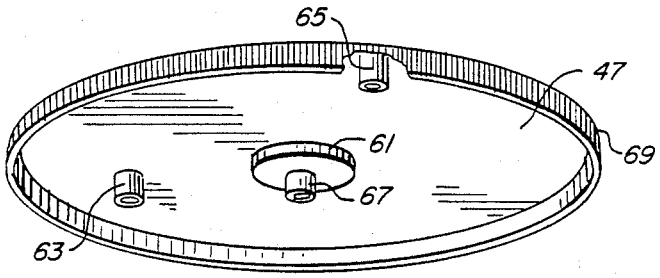
Figure 2C:
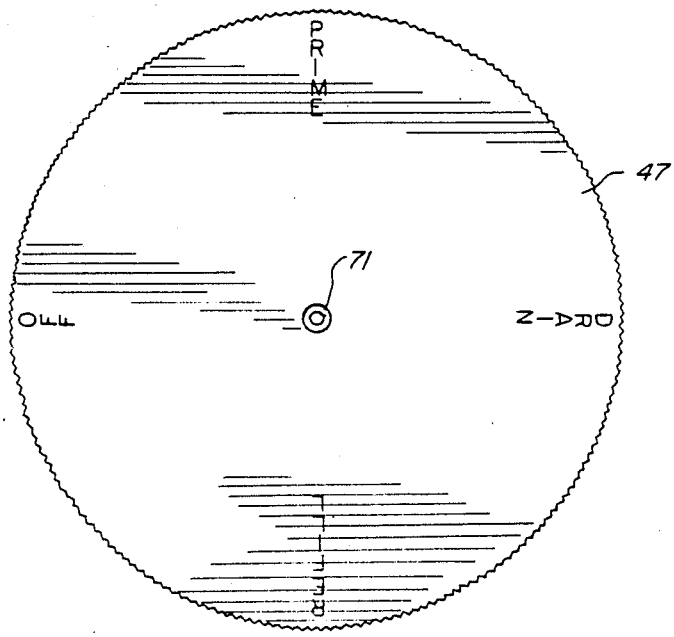

Opening and closing of the valve members 41, 43 and 45 is achieved through a suitable actuator, shown in FIG. 1 as a disk 47, which is intended to be turned in a counter-clockwise direction. Details of the disk 47 are shown in FIG. 2. From the bottom view of FIG. 2A, it may be seen that the disk has a central mounting structure 61 and two cam actuators 63 and 65 on its bottom side. In the perspective view of FIG. 2B, it may be further seen that the central mounting structure 61 includes an extending cylindrical mounting sleeve 67 suitable for directly engaging the actuating valve stem of valve member 41. Disk 47 is mounted directly on valve member 41 and is secured by a mounting screw inserted through a central recessed opening 71 in the disk, which is shown in FIG. 2C. Thus, as the disk 47 is rotated, the ball valve 41 is rotated in conjunction therewith.

Cam actuator 63 is located at a radius from the center of the disk 47 mounting structure 61 on valve 41. This radius is such that, when disk 47 is rotated counter-clockwise, cam actuator 63 will pass to the inside of the central mounting structure 79 but contact the raised cam portion 77 of cam followers 83 and 85 (when said cam followers and their associated valves 43 and 45 are in the closed position). This causes valves 43 and 45 to rotate clockwise one quarter turn to the open position, as cam actuator 63 is rotated past the respective valve members 43 and 45.

Cam actuator 65 is located at a greater radius from the center of the disk 47 mounting structure 61 than is cam actuator 63. Thus, when disk 47 is rotated counter-clockwise, cam actuator 65 will pass to the outside of the central mounting structure 79 but contact the raised cam portion 77 of cam followers 83 and 85 (when said cam followers and their associated valve members 43 and 45, respectively, are in the open position). This causes valve members 43 and 45 to rotate counter-clockwise to the closed position, as cam actuator 65 is rotated past the respective valve members.

It may be seen in FIG. 2B that knurls 69 are formed along the edge of disk 47 to aid in gripping and turning the disk 47.

Disk 47 has four primary operating positions, as shown thereon in FIGS. 1 and 2C, with indicator 49 on body member 21 demonstrating in which mode the apparatus is operating.

When the apparatus is in the OFF position, as illustrated in FIG. 5A, all three valve members 41, 43 and 45 are closed to prevent liquid flow. When disk 47 is rotated counter-clockwise one-quarter turn to the PRIME position, valve member 41 is opened by virtue of its direct connection to disk 47. Valve members 43 and 45 are opened by the action of cam actuator 63 in contacting cam followers 83 and 85 associated with the valve members 43 and 45, respectively, causing them to rotate one-quarter turn clockwise. The result, as illustrated in FIG. 5B, is that water from the garden hose 40 passes through the connector 39, as shown in FIG. 5D, to the "Y" 37 and thence to tubing section 23, which is connected to the the "Y" by a connector 51, and to tubing section 25, which is connected to the "Y" by a connector 53, as illustrated in FIG. 1.

With the disk 47 in the PRIME position, water flows through the tubing sections 23 and 25, priming the conduit for siphoning the contents of the radiator 31 to the disposal device 33. This water flow is primarily toward the second section of tubing 25, the end 29 of which is open to atmospheric pressure at ground level. Section 25 provides the path of least resistance, as compared to tubing section 23, the end 27 of which is immersed in up to twenty-four inches of coolant, which presents an additional resisting back pressure.

Siphoning begins immediately after the disk 47 is rotated counter-clockwise an additional one quarter turn, which again closes the directly-connected valve 41. This shuts off the water supply, while leaving valve members 43 and 45 open and connected through the passageway in the "Y" section 37, as illustrated in FIG. 5C. Such siphoning occurs because the weight and greater momentum of the longer column of water in the second section of tubing 25, which extends from the radiator top to ground level and which receives a major portion of the water flow during priming, combine to create a downward force in said tubing section 25 which exceeds the force required to draw liquid upward from the surface level of the coolant in the radiator. Coolant is drawn upward through tubing section 23, through body member 21 at the top of the conduit, and then falls downward again to below the surface level of the coolant in the radiator. Thus, the net downward force in the second section of tubing 25 initiates a flow toward the end 29 of the conduit. Flow continues because the equal atmospheric pressure acting on both the liquid in the radiator and the liquid in the disposal device, into which conduit end 29 is inserted, prevents the liquid and air in the two sections of tubing from splitting and creating a partial vacuum in the conduit.

Experiments indicate that, contrary to common conception, it is not necessary to create a continuum of liquid in the conduit to initiate siphoning. One embodiment of the present invention will initiate siphoning upon the water being turned off after the injection of less than one half pint of water, even if air coexists with the injected water at the top of the conduit.

Based on the present invention, it may be seen that the method of water injection occuring within body member 21 could be modified such that the force of injected water would be more specifically directed only to tubing section 25, relying on the venturi effect to draw coolant from the radiator sufficient to initiate siphoning. Also a small pump, powered either by hand-cranking or a small 12-volt DC electrical motor, or a suction bulb, could likewise be used to initiate siphoning, as alternatives to the method used in the preferred embodiment.

After the radiator has been drained, as evident from the absence of liquid in the transparent portion of tubing provided, the radiator may be refilled with water by turning the disk 47 an additional one-quarter turn counter-clockwise to the REFILL position. Doing so opens the directly-connected valve member 41; completely closes valve member 45 by action of cam actuator 65 contacting cam follower 85, causing valve member 45 to rotate counter-clockwise to the closed position; and partially closes valve member 43 by action of cam actuator 65 contacting cam follower 83 (but for less than the full extent of cam action). The result, as illustrated in FIG. 5D, is that in the REFILL position, water will flow from the garden hose 40 through valve members 41 and 43 only, through section 23 and into the radiator.

Valve member 43 is partially closed during radiator refilling in order to restrict the flow rate of water into the radiator during the REFILL step. This is done to avoid filling and overflowing the radiator tank immediately adjacent conduit end 27, before injected water has sufficient time to migrate to other portions of the cooling system. If this were to occur, the operator can be misled into believing the system has been fully refilled and thus shut the water flow off, when some portions of the system are, in fact, largely empty. It is especially important to avoid this condition when refilling after draining with the system at operating temperature, since more than just the radiator has been drained and the majority of the liquid drained should be replaced with fresh water on refilling, before the water flow is stopped and the engine is run. Operating the engine with the cooling system insufficiently filled could result in engine overheating and damage.

On the other hand, if the refilling rate is too slow, this unnecessarily increases the time required to accomplish refilling. With the foregoing in mind, and based on experimentation, it has been found that a refill rate of about five quarts per minute is preferred. In the case of a water supply at a typical household water pressure of 65 psi, delivered through a connected garden hose, the preferred flow rate may be achieved with a water inlet orifice approximately equivalent to the area of a seven sixty-fourths inch diameter circle (or 0.0094 square inch area).

Upon filling of the radiator with fresh water, disk 47 is rotated counter-clockwise a final one quarter turn, returning disk 47 to the original OFF position, illustrated in FIG. 5A. This action again closes the directly-connected valve member 41, shutting off the water supply, and fully closes valve member 43 by the action of cam actuator 65 having fully passed by cam follower 83, causing valve member 43 to fully rotate counter-clockwise to the closed position.

With tubing section 23 still inserted in the radiator, but all liquid flow thus blocked by virtue of valve members 41, 43 and 45 all being closed, the vehicle may be started and run for approximately five minutes, or for whatever time is required to raise the operating temperature to the point required to actuate the thermostat and permit coolant stored in the engine, heater and interconnecting hoses to circulate and mix with the fresh water in the radiator. Since a typical vehicular water pump can pump many times the cooling system's capacity each minute, and an open thermostat will likewise permit many times the cooling system's capacity to circulate between the engine and radiator each minute, thorough mixing of remaining old coolant with the fresh water added to the radiator occurs quickly after the thermostat opens. During idling of the engine, the operator empties and repositions the disposal device 33, shown in FIG. 1.

After running the engine to circulate remaining old coolant with the fresh water which has been added, the engine is stopped, and the foregoing series of draining, refilling and engine running steps is promptly repeated. The present invention makes it safe to perform a draining with the system at operating temperature because:

(1) the first section of conduit was not removed from the radiator and the radiator cap was not replaced, with the result that the system was not pressurized during idling; and (2) the operator need only come in contact with the body member 21 of the present invention, not any parts of the cooling system which are at temperatures which could cause burns.

The advantage of being able to redrain the radiator while the system is still at operating temperature is that the thermostat will remain open for a period of time after the engine is shut off, thereby permitting some of the coolant contained in the engine, heater and hoses to flow to the radiator and be siphoned out along with the coolant originally contained in the radiator itself. The amount of coolant from the engine, heater and hose portions of the cooling system which will be siphoned out in addition to coolant content of the radiator is determined by the siphoning rate of the present invention, the time required for the thermostat to close and ultimately by the lowest level to which the engine block can be drained through the water pump / lower engine-to-radiator hose housing. As the radiator is siphoned to a level below the level of the open thermostat, the level of warm coolant in contact with the open thermostat will begin to fall. Once the thermostat's temperature sensing surface loses contact with the warm coolant, the thermostat will begin to close. Since the thermostat is typically located at the top of the engine block (or in some cases in the top engine-to-radiator hose), the level of coolant will begin to drop away from the thermostat soon after siphoning of the radiator has begun.

While the time required for the thermostat to fully close and restrict further coolant flow into the radiator for draining will vary with the type of vehicle, the temperature of the coolant, and the temperature of the metal surrounding the thermostat, experiments indicate that a typical fully-open thermostat requires approximately twenty seconds to fully close when removed from contact with the warm coolant and exposed to an ambient air temperature of 70° F. This is considered to be the shortest time during which the thermostat will be at least partially open, permitting some of the coolant originally contained in the engine, heater and hoses to migrate to the radiator for siphoning out. In practice, the thermostat can be expected to take somewhat longer than twenty seconds to close, owing to the effects of residual heat and humidity inside the engine after the engine coolant level has dropped, and to the heat conducted from the engine block (or hose) to the thermostat.

In any event, experiments indicate that some portion, but not all, of the coolant contained in the engine, heater and hoses will migrate to the radiator and be drained by the siphon before the thermostat can fully close and prevent such migration, when the siphoning begins with the system at operating temperature. For example, in one such experiment, whereas the initial draining with the system cold removed only 35% of the total system capacity, each subsequent draining with the system at operating temperature removed 57% of the total system capacity. In every experiment, siphoning of the radiator, initiated with the system at operating temperature (and the engine off), removed at least 50% of the total cooling system capacity.

After again draining, refilling and idling the engine a second time, the final draining of the exemplary system will once more remove 57% of the total capacity of the system, since the draining again takes place with the system at operating temperature.

To summarize the results of the foregoing method for this particular example:

| | % of Total Capacity Removed | % of Original Used Coolant Removed | Balance of Original Coolant Remaining |
|---|---|---|---|
| 1st Drain | 35 | 35 | 65% |
| 2nd Drain | 57 | 37 | 28% |
| 3rd Drain | 57 | 16 | 12% |

After the third draining, the operator removes the first conduit section 23 from the radiator before recharging the system with fresh antifreeze. At this time, the system is filled to 43% of its total capacity with liquid which is 88% clean water, 6% original water and 6% original antifreeze (assuming the system started with the usual 50—50 antifreeze to water mix).

Thus, the operator of the present invention can refill his system with antifreeze straight from the bottle and fall within the recommended range of antifreeze to water mix, which is 50% to not more than 70%, antifreeze to water. In the system of this example, a straight antifreeze refill will result in an antifreeze to water mix of 63% (57% of system capacity added plus 6% of original antifreeze still in the system). After filling the system to capacity with antifreeze, the operator replaces the radiator cap.

The apparatus and method of the present invention also enables the operator to utilize many commercially available chemical cleaning agents, where needed to remove corrosion and scale which is not in suspension. Use of a cleaning agent may be achieved with virtually no added effort, other than pouring in the cleaning agent after the first draining and before the first refill, and idling the engine for a somewhat longer period of time, as specified by the cleaning agent instructions.

Further, the apparatus and method can be used to flush out the reservoir ("overflow") bottle without removing it from the vehicle, which is the current practice. The operator simply removes the bottle's cap, inserts the first section of conduit 23 (previously installed in the radiator) into the bottle and follows the drain and refill steps to first drain and then partially refill the bottle to one half of its capacity. The operator then fills the bottle to full capacity with straight antifreeze.

Finally, unlike other system flushing techniques, the present invention minimizes and fully contains used coolant and flush water. This feature is highly desirable inasmuch as ethylene glycol, the primary component of antifreeze, is harmful or fatal if swallowed and is poisonous to animals, who may nevertheless be attracted by its sweet taste. The total waste generated by the present invention amounts to typically 150% of the capacity of the system being flushed. This waste liquid is conveyed, at low pressure and without splashing, into the disposal device 33, which may be a common household bucket, placed on the ground anywhere within reach of the end 29 of tubing section 25, as illustrated in FIG. 1. It is not necessary for the operator of the present invention to have a special purpose disposal device which will fit under the vehicle.

Another preferred embodiment of the present invention is illustrated in FIGS. 6–11. As shown in FIG. 6, a housing 89 has a first section 91, a second section 93 and a third section 95. The first section 91 is connected to a waste bucket or other disposal device by a section of tubing or hose 97 (corresponding to the section of tubing 25 in the FIG. 1 embodiment). A conventional garden hose 99 is also releasably connected to the section 91. A tubing section or conduit 101 (corresponding to the section of tubing 23 in the FIG. 1 embodiment) extends from the third section 95 to the radiator of a vehicle in which the coolant is to be changed.

As may be seen in FIGS. 6 and 7, an indicator 103 on the second section 93 points to three operating positions designated on the first section 91. These three operating positions are the "OFF" position 105, the "DRAIN" position 107, and the "REFILL" position 109. As explained in more detail hereinafter, there is also a fourth position, the "PRIME" position in which hoses 97 and 101 are injected with water as the second section 93 is rotated from the "OFF" to the "DRAIN" position.

Looking at the end of the section 95, shown in FIG. 8, mounting screws or pins 111 and 113 may be seen. These mounting screws 111 and 113 extend from the section 95 to the section 91 (see FIG. 9), to maintain sections 91, 93 and 95 in the composite housing structure 89. In addition, the screws 111 and 113 provide stops for the rotating second section 93.

The exploded cross-sectional view of FIG. 9 illustrates the composite structure of housing 89 in relation to sections 91, 93 and 95. Thus, section 91 is provided with a mounting extension 115 to receive the hose 97, shown in FIG. 6. A passageway 117 through the mounting extension 115 also extends through the main portion of the section 91. At the bottom of section 91, a conventional female garden hose fixture 119 is provided with threads 121 to engage the corresponding threads on the male portion of a conventional garden hose 99, shown in FIG. 6. An inlet opening 123 for water from the garden hose 99 is stepped down to a smaller size, one quarter inch in this preferred embodiment, from the garden hose diameter. O-ring 127 is utilized to seal off water flow from the garden hose 99, while O-ring 125 is utilized to preclude water leakage outwardly, and air leakage inwardly, at the interface between the section 91 and the section 93. To achieve this, proper grooves 129 and 131 are provided for the O-rings 125 and 127, respectively. Appropriate pilot openings 133 and 135 are provided in the section 91 to receive the mounting screws 111 and 113, respectively.

Section 95 is provided with a mounting extension or projection 137 for the tubing section 101, shown in FIG. 6, and recessed screw slots 136 and 138, through which screws 111 and 113 are, respectively, inserted. A passageway 139, through projection 137 and the rest of the section 95, aligns with and has the same internal diameter as the passageway 117 through the section 91 (in this preferred embodiment, the internal diameter is three-eighths of an inch). A projecting portion 141 on section 95 provides a mounting area 143 for a pivot pin 145 on section 93. An area 147 in section 95 provides a liquid containing area for water injected during priming and refill operations, and for coolant and flush materials being removed from the radiator during the drain operation. O-ring 146 is utilized to preclude water leakage outwardly, and air leakage inwardly, at the interface of the section 95 with the section 93. To achieve this, an appropriate groove 148 is provided in the section 95 for O-ring 146.

Section 93 is a rotating disk member positioned by its pivot pin 145 in the mounting area 143 of section 95. An outer flange 149 of section 93 overlaps sections 91 and 95, on the peripheries of the latter sections, and is provided with knurling 150 on its periphery, to facilitate gripping. A central disk member 151 of the section 93 is provided with several openings, as shown in FIG. 10. Elongated arcuate openings 153 and 155 have mounting screws 111 and 113 extending therethrough, respectively. Radially inside openings 153 and 155 there are located a larger opening 157 and a smaller opening 159. Openings 157 and 159 operate in conjunction with the water inlet opening 123 and the passageway 117 in the section 91, respectively, to control the various flow paths as the rotating disk member 93 is rotated The precise operation of these openings may be seen from FIG. 10, taken in conjunction with the view of section 91 in FIG. 11. The view of FIG. 11 is from the section 93 side of section 91, and if the view of FIG. 10 is mentally superimposed on the view of FIG. 11, the interaction of the openings 157 and 159, in central disk portion 151 of section 93, with the passageway 117 and the water inlet opening 123, respectively, in section 91, to control liquid flow may be followed.

Thus, beginning with the indicator 103 on the section 93 aligned with the "OFF" designator 105 on the section 91, it may be seen that opening 159 of the section 93 is not aligned with the water inlet opening 123 of the section 91, nor is the opening 157 of the section 93 aligned with the passageway 117 in the section 91. As a result, water is prevented from passing through the section 93 into area 147 of section 95, and liquid is likewise prevented from entering the passageway 117 of section 91, for conveyance to the disposal means. In addition, when disk member 93 is in this position, screws 111 and 113 are at the ends of arcuate openings 153 and 155, respectively, preventing further rotation of disk member 93 in a counter-clockwise direction ( as shown in FIG. 10 from the viewer's perspective).

With a garden hose 99 from an open faucet or other source of water under pressure attached to connection 119 of the section 91 and tubing section 101 inserted through the radiator cap opening to the bottom of the radiator, the operator rotates the disk member 93 clockwise (from the viewer's perspective) toward the "DRAIN" position 107 designated on the section 91. As disk member 93 is rotated, opening 159 comes into alignment with the water inlet 123 in the section 91, permitting water to pass through center disk member 151 and into area 147 of the section 95, and thence outwardly through passageway 139 of the section 95 into tubing section 101. In addition, as rotation of disk member 93 continues, opening 157 comes into alignment with passageway 117 in the section 91, allowing water flowing into area 147 in the section 91 to pass through the central disk member 151 and through passageway 117 into hose 97. As a result, both tubing section 101, leading to the radiator, and hose 97, leading to the disposal device, are "primed" for siphoning.

When continued rotation of disk member 93 brings its indicator 103 into alignment with the "DRAIN" designation 107 on the section 91, opening 159 has fully passed, and is no longer overlapping, water inlet opening 123 in the section 91, stopping the flow of water to area 147 of the section 95. However, at this position, opening 157 is still aligned with passageway 117 of the section 91, permitting continued flow of liquid from area 147 of the section 91, through opening 157 to passageway 117. The result is that siphoning of coolant from the radiator, through tubing section 101, area 147 in the section 95, opening 157 in the disk member 93, passageway 117 in the section 91, and thence through hose 97 to the disposal device commences immediately. It should be noted that, in this position of disk member 93, mounting screws 111 and 113 are now at the opposite ends of arcuate openings 153 and 155, respectively, from their original positions with disk member 93 in the "OFF" position. This prevents further clockwise (from the viewer's perspective in FIG. 10) rotation of the disk member 93.

After the radiator has been drained, the disk member 93 is rotated counter-clockwise (from the viewer's perspective in FIG. 10) until its indicator 103 aligns with the "REFILL" designation 109 on the section 91. In this position of disk member 93, the opening 157 in central disk member 151 is not in alignment with passageway 117 in the section 91, and thus flow of liquid between area 147 in the section 95 and the passageway 117 in the section 91 leading to the disposal device is prevented. Opening 159 in central disk member 151 partially overlaps water inlet opening 123 in the section 91, permitting a reduced flow of water to pass through to area 147 in the section 95, and thence through passageway 139 and tubing section 101 into the radiator. The radiator is thus refilled at a desired flow rate established in accordance with the principles described above.

When the radiator refilling is complete, the operator rotates disk member 93 counter-clockwise (from the viewer's perspective in FIG. 10) back to its original position, with indicator 103 aligned with the "OFF" designation 105 on the section 91. With the disk member in this position, and all flow of liquid through the housing 89 thus blocked, the engine is run to circulate the remaining used coolant and corrosion and the fresh water added to the radiator. Tubing section 101 is still inserted in the radiator, in preparation for repeating the above described sequence, which the operator may continue as often as desired.

From the foregoing, it may be seen that a relatively inexpensive device and method, have been provided, with the capability of flushing a high percentage of old coolant and corrosion from a vehicle cooling system. The device and method may be used by any non-skilled operator, since they require only removal of the radiator cap and rotation of a dial to three positions in a simple sequence In addition, the invention: (1) prepares the cooling system for simplified recharging with an acceptable mix of antifreeze and water; (2) allows the operator to chemically flush his system, if he desires, with virtually no extra effort; (3) allows the operator to flush out his reservoir bottle without having to remove it from his vehicle; and (4) minimizes and fully contains all used coolant and waste water for proper disposal.

Although the preferred embodiments have been described above, it should be understood that various modifications, changes and variations may be made in the arrangement, operation and details of construction of the elements disclosed herein without departing from the spirit and scope of this invention.

I claim:

1. Apparatus for use in changing coolant in the cooling system of a vehicle having a side tank radiator, with a radiator cap to close a radiator cap opening, comprising:

conduit means adapted to convey liquid to and from the radiator, a first end of said conduit means adapted to extend into the radiator through the radiator cap opening and a second end of said conduit means adapted to lead to a disposal means for receiving liquid removed from the radiator, said second end of said conduit means being located at a level at or below the level to which it is desired to drain the radiator;

connecting means adapted to connect the apparatus to a source of water from which water is conveyed to said conduit means intermediate said first and second ends; and control means adapted to selectively direct water into said conduit means to prime said conduit means for siphoning and then discontinue flow of water into said conduit means to permit siphoning of the contents of the radiator to the disposal means.

2. Apparatus as claimed in claim 1 wherein said control means comprises:

a body member having said connecting means associated therewith, said body member being connected to said conduit means intermediate said first and second ends thereof; and manually actuatable valve means associated with the body member adapted to selectively direct water from said connecting means into aid conduit means.

3. Apparatus as claimed in claim 2 wherein said conduit means comprises:

a first section of tubing connected to said body member at one end, with the opposite end being said first end of said conduit means;

a second section of tubing connected to said body member at one end, with the opposite end being said second end of said conduit means; and a passageway at said body member to interconnect the ends of said first and second sections of tubing.

4. Apparatus as claimed in claim 3 wherein said passageway is selectively completed through said valve means.

5. Apparatus as claimed in claim 3 wherein said first and second sections of tubing are flexible hose.

6. Apparatus as claimed in claim 5 wherein a portion of said first section of tubing adjacent said first end of said conduit means comprises a section of relatively rigid pipe.

7. Apparatus as claimed in claim 6 and further comprising notches formed in said relatively rigid pipe at said first end of said conduit means to prevent said first end from being obstructed in the radiator to interfere with liquid flow.

8. Apparatus as claimed in claim 3 wherein said valve means comprises:

manually actuatable cam means; and cam follower means responsive to actuation of said cam means and adapted to sequentially open a flow of water from said connecting means to both of said first and second sections of tubing to prime said conduit, close the flow of water to both of said sections of tubing to permit siphoning of the contents of the radiator from the radiator, and open a flow of water to just said first section of tubing to fill the radiator with water after the contents thereof have been siphoned out.

9. Apparatus as claimed in claim 3 wherein a portion of at least one of said sections of tubing is transparent to permit visual observation of fluid flow therethrough.

10. Apparatus as claimed in claim 1 wherein the source of water is a garden hose connected to a supply of water under pressure.

11. Apparatus as claimed in claim 1 and further comprising means to prevent obstruction of said first end of said conduit means while in the radiator.

12. Apparatus as claimed in claim 1 wherein said control means is adapted to selectively direct water to the radiator through said conduit means after the contents of the radiator have been siphoned out.

13. Apparatus as claimed in claim 12 wherein said control means and said conduit means are adapted to establish water flow into the radiator at a rate which refills the radiator as quickly as possible without causing it to be filled too quickly to permit migration of the water to other parts of the cooling system, which could permit it to erroneously appear that the cooling system has been completely replenished.

14. Apparatus as claimed in claim 13 wherein said control means and said conduit means are adapted to establish the rate at which refill water is directed into the radiator to be about five quarts per minute.

15. Apparatus as claimed in claim 3 wherein said valve means comprises:

a manually actuatable rotatable disk positioned to intersect said passageway; said disk having an off position, a drain position and a refill position and at least one opening formed in said disk to selectively complete said passageway through said disk.

16. Apparatus as claimed in claim 15 wherein said valve means further comprises a second opening formed in said disk adapted to selectively direct water from said connecting means to said conduit means.

17. Apparatus as claimed in claim 16 wherein said first and second openings are positioned so that as said disk is rotated from said off position to said drain position water would be directed to said conduit means to prime said conduit means for siphoning, with said passageway being completed in the drain position so that the contents of the radiator would be siphoned out, and rotation of said disk to said refill position would permit water from said connecting means to be conveyed to the radiator through said first section of tubing.

18. Apparatus for use in changing coolant in the cooling system of a vehicle having a side tank radiator, with a radiator cap to close a radiator cap opening, comprising:

a body member;

a hose connector for attaching a garden hose to said body member to provide a source of water;

a first section of tubing connected to said body member and adapted to be inserted into the radiator through the radiator cap opening;

a second section of tubing connected to said body and adapted to extend to a disposal means;

a passageway formed inside said body member to form a continuous conduit with said first and second sections of tubing;

a manually actuatable disk mounted for rotation in said body member, said disk intersecting said passageway and adapted to block water flow through said hose connector, said disk having an off position, a drain position, and a refill position;

a first opening formed in said disk to selectively complete said passageway through said disk when said disk is in the drain position; and a second opening formed in said disk and adapted to selectively provide a path for water from said hose connector to the radiator side of said passageway, rotation of said disk from the off position to the drain position would momentarily provide the path for water to said passageway to prime said conduit for siphoning, said passageway being completed through said first opening as said disk approaches the drain position, and the path for the water to said passageway would be provided when said disk is in the refill position, at which position said disk would prevent water flow to said second section of tubing.

19. Apparatus for use in changing coolant in the cooling system of a vehicle having a side tank radiator, with a radiator cap to close a radiator cap opening, comprising:

conduit means adapted to be inserted into the radiator through the radiator cap opening after removal of the radiator cap, unsealed insertion of said conduit means into the radiator being the only interface of the apparatus with the cooling system of the vehicle;

extraction means for withdrawing cooling liquid from the radiator through said conduit means;

injection means for causing fresh water to be transmitted to the radiator through said conduit means; and control means for selectively activating said extraction means and said injection means.

20. Apparatus as claimed in claim 19 wherein said extraction means comprises a siphon formed by properly priming said conduit means upon actuation of said control means to activate said extraction means.

21. Apparatus as claimed in claim 19 wherein said injection means comprises connecting means adapted to provide water from a source of water under pressure, actuation of said control means to activate said injection means directing the pressurized water into said conduit means.

22. Apparatus as claimed in claim 19 wherein said control means and said conduit means are adapted to establish water flow into the radiator at a rate which refills the radiator as quickly as possible without causing it to be filled too quickly to permit migration of the water to other parts of the cooling system, which could permit it to erroneously appear that the cooling system has been completely replenished.

23. Apparatus as claimed in claim 22 said wherein control means and said conduit means are adapted to establish the rate at which refill water is directed into the radiator to be about five quarts per minute.

24. Apparatus for use in changing coolant in the cooling system of a vehicle having a side tank radiator, with a radiator cap to close a radiator cap opening, comprising:

a section of tubing adapted to be inserted into the radiator after removal of the radiator cap, unsealed insertion of said section of tubing into the radiator being the only interface of the apparatus with the cooling system of the vehicle;

a hose connector adapted for attachment to a source of water under pressure; and control means associated with said section of tubing and said hose connector and adapted to selectively cause the contents the radiator to be drained from the radiator through said section of tubing and fresh water from said hose connector to be injected into the radiator through said section of tubing.

25. Apparatus as claimed in claim 24 wherein said hose connector is adapted to be attached to a garden hose extending from a standard water faucet.

26. Apparatus as claimed in claim 25 wherein water injected through said hose connector is the only source of energy for the apparatus, other than manual actuation of said control means.

27. Apparatus as claimed in claim 24 wherein said control means and said tubing are adapted to establish water flow into the radiator at a rate which refills the radiator as quickly as possible without causing it to be filled too quickly to permit migration of the water to other parts of the cooling system, which could permit it to erroneously appear that the cooling system has been completely replenished.

28. Apparatus as claimed in claim 27 wherein said control means and said tubing are adapted to establish the rate at which refill water is directed into the radiator to be about five quarts per minute.

29. Apparatus for use in changing coolant in the cooling system of a vehicle having a side tank radiator, with a radiator cap to close a radiator cap opening, comprising;

a body member;

first connecting means on said body member, said first connecting means adapted to secure a first section of tubing to said body member, the first section of tubing being adapted to extend into the radiator through the radiator cap opening;

second connecting means on said body member, said second connecting means adapted to secure a second section of tubing to said body member, the second section of tubing being adapted to lead to a disposal means with the end of the second section of tubing at said disposal means being located at a level at or below the level to which it is desired to drain the radiator;

a passageway formed in said body member between said first connecting means and said second connecting means;

third connecting means on said body member, said third connecting means adapted to attach said body member to a source of water under pressure; and manually actuatable control means to selectively open said passageway between said first connecting means and said second connecting means and to selectively open a path for water from said third connecting means to said passageway adjacent said first connecting means.

30. Apparatus as claimed in claim 29 wherein the source of water is a garden hose.

31. Apparatus as claimed in claim 29 wherein said control means comprises a manually actuatable disk.

32. Apparatus as claimed in claim 31 wherein said disk is positioned to intersect said passageway and block water from said third connecting means, openings formed in said disk for selectively completing said passageway therethrough and selectively providing a path for water from said third connecting means to said passageway on the side of said disk adjacent said first connecting means.

33. Apparatus as claimed in claim 31 wherein said control means further comprises valve means, associated with each said connecting means said disk being mounted for direct actuation of said valve means associated with said third connecting means and having cam actuators to engage cam followers associated with said valve means as associated with said first and second connecting means.

34. Apparatus for use in changing coolant in the cooling system of a vehicle having a side tank radiator, with a radiator cap to close a radiator cap opening, comprising:

a section of tubing adapted to be inserted into the radiator after removal of the radiator cap, unsealed insertion of said section of tubing into the radiator being the only interface of the apparatus with the cooling system of the vehicle;

means to prime said section of tubing for siphoning; and injection means to introduce fresh water into said section of tubing for transmittal to the radiator, after the contents of the radiator have been siphoned out, to refill the radiator.

35. Apparatus as claimed in claim 34 and further comprising flow rate determining means to establish water flow into the radiator at a rate which refills the radiator as quickly as possible without causing it to be filled too quickly to permit migration of the water to other parts of the cooling system, which could permit it to erroneously appear that the cooling system has been completely replenished.

36. Apparatus as claimed in claim 35 wherein said flow rate determining means establishes the rate at which refill water is directed into the radiator to be about five quarts per minute.

37. A method for changing coolant in the cooling system of a vehicle having a side tank radiator, with a radiator cap to close a radiator cap opening, comprising the steps of:

(a) inserting a first end of conduit means into the vehicle radiator through the radiator cap opening without forming a sealed connection, said unsealed insertion of said conduit means being the only required contact of an operator with the vehicle cooling system;

(b) extending a second end of said conduit means to a disposal means, said second end being located at or below the level of said first end;

(c) connecting a source of water to said conduit means intermediate said first and second ends;

(d) causing water from said source to flow into said conduit means to prime said conduit means for siphoning liquid from the radiator; and (e) discontinuing the flow of water into said conduit means so that the contents of the radiator are siphoned to said disposal means.

38. A method as claimed in claim 37 and further comprising the steps of:

(f) causing water from said source to flow toward only said first end of said conduit means, after the contents of the radiator have been siphoned out, in order to fill the radiator with fresh water;

(g) running the vehicle to circulate the fresh water in the radiator and coolant remaining in the cooling system in order to mix the water and the remaining coolant; and (h) repeating the steps (a)–(e).

39. A method as claimed in claim 38 and further comprising repeating the steps (f)–(h) a desired number of times.

40. A method as claimed in any of the claims 37, 38 or 39 and further comprising the step of filling the radiator with new antifreeze after the radiator has been drained.

41. A method for changing coolant in the cooling system of a vehicle having a side tank radiator, with a radiator cap to close a radiator cap opening, comprising the steps of:

inserting a section of tubing into the radiator through the radiator cap opening without creating a sealed connection between said section of tubing and the radiator at said opening, said unsealed insertion of tubing being the only required contact of an operator with the cooling system of the vehicle;

extracting the contents of the radiator through said section of tubing; and injecting fresh water into the radiator through said section of tubing to refill the radiator said step of injecting fresh water to refill the radiator comprises injecting the fresh water at a rate which refills the radiator as quickly as possible without causing it to be filled too quickly to permit migration of the water to other parts of the cooling system, in order to prevent it from erroneously appearing that the cooling system has been completely replenished.

42. A method as claimed in claim 41 wherein the rate at which water is injected to refill the radiator is about five quarts per minute.

* * * * *